United States Patent [19]

Tatum et al.

[11] 4,210,070

[45] Jul. 1, 1980

[54] CEILING FIXTURE WITH THERMAL PROTECTION

[76] Inventors: James R. Tatum, 20 Winterton Dr., Islington, Ontario; Barry R. Dayus, 2021 Ardleigh Rd., Oakville, Ontario, both of Canada

[21] Appl. No.: 883,952

[22] Filed: Mar. 6, 1978

[51] Int. Cl.[2] ..... F24F 7/00

[52] U.S. Cl. ..... 98/40 D; 98/40 DL; 428/192; 428/193; 428/240; 428/246; 428/251; 428/280; 428/282; 428/285; 428/402; 428/920

[58] Field of Search ..... 98/40 D, 40 DL; 428/228, 251, 252, 257, 920, 280, 281, 282, 192, 193, 246, 240, 285, 402

[56] References Cited

U.S. PATENT DOCUMENTS

| | | | |
|---|---|---|---|
| 2,867,035 | 1/1959 | Patterson | 428/920 |
| 2,939,811 | 6/1960 | Dillon | 428/920 |
| 3,004,877 | 10/1961 | Simms et al. | 428/920 |
| 3,518,156 | 6/1970 | Windecker | 428/251 |
| 3,830,687 | 8/1974 | Re et al. | 428/920 |
| 3,919,444 | 11/1975 | Shayman | 428/920 |

*Primary Examiner*—James J. Bell

[57] ABSTRACT

A flexible thermal barrier material for use in the fabrication of thermal shields or fire barriers for disposition over fixtures such as a lighting fixture or an air diffuser in a suspended ceiling comprises a flexible pad of non-flammable and frangible fibrous felt-like ceramic material movably disposed between two flexible, non-flammable and structurally durable panels of a sleeve usefully of a woven glass fibre cloth which in turn is usefully impregnated with aluminum powder in a thermoplastic base. Such thermal barrier material is easily cut and stapled together to provide such a thermal shield or fire barrier of a desired configuration.

10 Claims, 5 Drawing Figures

CEILING FIXTURE WITH THERMAL PROTECTION

FIELD OF THE INVENTION

The present invention relates to a thermal barrier material and to thermal shields or fire barriers fabricated from such material for use over ceiling fixtures so as to enable the construction of a composite ceiling structure having a uniform overall fire rating.

BACKGROUND OF THE INVENTION

Ceiling structures, such as suspended ceilings, are typically made with an interlocking grid of struts or tees, suspended from the concrete slab of the roof or the floor of the next storey of the building and having panels of acoustic or similar material supported on such struts.

Ceiling structures may also be of gypsum wallboard, plasterboard, plaster or the like and this invention is equally applicable to the thermal protection of fixtures in such other ceiling types.

Principally, this invention is concerned with ceilings which are located in multi-storey public and commercial buildings but the invention is broadly applicable to any type of building or ceiling structure where services are provided in the space or void between the ceiling and the concrete slab, roof or other structure disposed above such a ceiling.

Such ceilings incorporate various fixtures such as lighting troffers, air-handling diffusers and grilles, and, in some cases, loudspeakers for music or public address systems.

Building codes customarily require that such a composite ceiling structure have a predetermined fire rating; the ceiling must remain intact and protect the so-called void, i.e. the space between the ceiling and the overlying slab or roof, from excessive heat for a certain period of time in the event of fire below the ceiling.

Usually, the acoustic panels or other ceiling materials themselves are fireproof and are highly resistant to the transmission of heat so that they constitute adequate thermal protection for the ceiling void.

However, where there are openings through the ceiling for the various fixtures installed therein, the ceiling void may be virtually unprotected. The ceiling fixtures are usually made of relatively thin sheet metal and such metal will, of course, transmit heat from a fire quite rapidly into the ceiling void.

For these reasons, building codes require that the ceiling fixtures themselves be provided with some form of barrier, enclosure or shield of fireproof or heat-proof material over the fixture.

In the great majority of cases, such shields are presently fabricated from relatively rigid fireproof materials such as gypsum wallboard, ceiling tile or the like by cutting such material generally into rectangular pieces which are then roughly assembled in place in the form of a box over the lighting or other ceiling fixture. Such known shields are often loosely fastened together with nails.

The custom fabrication of such fireproof enclosures on a building site is wasteful of labour and unreliable. Additionally, it causes confusion as to the division of responsibility between the various trades.

In addition, materials such as gypsum wallboard are relatively fragile and are not, therefore, easily formed or fabricated into such rectangular box-like enclosures. In many cases, the effectiveness of the fire protection provided by such enclosures is drastically reduced after a period of time since they often have a relatively flimsy insecure construction and may fall apart or become seriously damaged, for example, when maintenance work is being carried out in the ceiling void. Frequently, such damaged boxes cannot be repaired or the repair effected by a tradesman might be totally inadequate.

While other forms of heat-resistant material and thermal insulation are available, they are in very many cases possessed of similar inherent disadvantages when considered for this purpose. Ceiling fixtures come in so many different shapes and sizes that the prefabrication of specially shaped shields or enclosures for such a variety of fixtures would be too costly and impractical.

For all these reasons, it is, therefore, highly desirable to provide a thermal shield for use over a ceiling fixture so as to provide thermal protection and which shield is simple and inexpensive to manufacture, simple and effective in use and not easily damaged or destroyed in use and particularly during servicing of the ceiling fixture. Additionally, such a shield should remain effective for its intended purpose throughout the useful life of the ceiling structure itself. It is also desirable to provide a thermal barrier material which will be readily adaptable to a variety of different uses and which may be cut, shaped, fastened, etc., to fabricate such a thermal shield, without special tools or fasteners, other than those normally available on a building site.

One important object of this invention is, therefore, to provide a novel thermal barrier material for the fabrication of thermal shields and which material presents the aforementioned characteristics.

Yet another object of this invention is to provide a thermal shield or fire barrier for disposition over a fixture in a ceiling structure for the purpose of reducing the transmission of heat upwardly through such a fixture.

A further object of this invention is to provide a thermal shield or fire barrier for the aforesaid purpose and which shield presents one or more of the desired characteristics as hereinbefore identified for such a shield.

Other objects of the invention will become apparent as the description herein proceeds.

SUMMARY OF THE INVENTION

Broadly, a thermal barrier material in accordance with this invention can be defined as comprising a flexible pad of essentially non-flammable and frangible batting disposed between two sleeve panels of a flexible, structurally durable and essentially non-flammable material, said sleeve being closed along at least two opposed edges thereof.

While the sleeve panels of the thermal barrier material as provided by this invention can be formed of any suitable flexible, structurally durable and essentially non-flammable material, such sleeve panels are usefully formed of a woven glass fibre cloth. In order to improve the thermal shielding effect and structural durability of such thermal barrier material, such glass fibre cloth is usefully impregnated with aluminum powder in a thermoplastic base.

The flexible pad of batting within the thermal barrier material provided by this invention can be formed of any suitable flexible material but it is preferred to use, for such pad, a fibrous felt-like ceramic material.

For reasons which will be more readily understood as the description herein proceeds, the pad of batting within the thermal barrier material of this invention is movably disposed between the outer sleeve panels and is not bonded or otherwise secured to such panels.

As already indicated, the present invention also embraces novel thermal shields or fire barriers for use over ceiling fixtures and, in accordance with this invention, such a shield is fabricated from at least one piece or sheet of the novel thermal barrier material as hereinbefore defined.

Such a shield can, for example, be fabricated by securing at least two sheets of such thermal barrier material together using fasteners such as staples to provide a three-dimensional structure having such a configuration that it can be disposed over a ceiling fixture to reduce upward heat transmission therethrough. Alternatively, such a thermal shield as provided by this invention can be fabricated from a single sheet of the aforesaid thermal barrier material by deforming such a sheet into a desired three-dimensional configuration and then retaining it in that configuration by the use of at least one staple or other suitable fastener engaging such a sheet.

Where the ceiling fixture is a lighting troffer, the thermal shield will generally have a generally rectangular inverted trough-like configuration with side walls, end walls and a top wall, preferably with overlapping wall portions where separate sheets of the thermal barrier material are joined.

Where the fixture is an air diffuser of the square-to-round or square-to-square type, then the shield will usefully be in the form of a flattened pyramid having four side walls and a top opening surrounding the air duct, with overlapping wall portions where junctions occur. Such a shield is usefully formed from four sheets of the thermal barrier material which overlie the top surfaces of the air diffuser and which overlap each other at their ends and which are fastened together, for example, by staples.

Alternatively, a thermal shield for such an air diffuser fixture can be formed from a single piece of the thermal barrier material which piece is wrapped fully around the fixture and then secured to itself to provide a one-piece shield.

In addition to the novel thermal barrier material and the thermal shields or fire barriers fabricated from that material, this invention also embraces the combination in a ceiling structure of a three-dimensional ceiling fixture and disposed thereover a thermal shield as provided by this invention.

As well as being easily and inexpensively formed into thermal shields of a wide range of shapes and sizes for use over a large variety of different fixtures, the thermal barrier material of this invention presents the important advantage that the flexible sleeve panels serve to hold the enclosed flexible pad of frangible batting in position and to prevent the loss of fibres from the preferred fibrous felt-like material to contaminate the building atmosphere.

Other features of the thermal barrier material of this invention and of thermal shields fabricated from such material and the advantages presented thereby particularly during the use of such thermal shields over ceiling fixtures of different types in a typical ceiling structure will become apparent as the description herein proceeds.

The various features of novelty which characterize the invention are pointed out with particularity in the claims annexed to and forming a part of this disclosure. For a better understanding of the invention, its operating advantages and the specific objects attained by its use, reference should be had to the accompanying drawings and descriptive matter in which there are illustrated and described preferred embodiments of the invention.

BRIEF DESCRIPTION OF THE DRAWINGS

The invention will now be described merely by way of illustration with reference to the accompanying drawings, in which.

DESCRIPTION OF THE PREFERRED EMBODIMENTS

Figure 1:
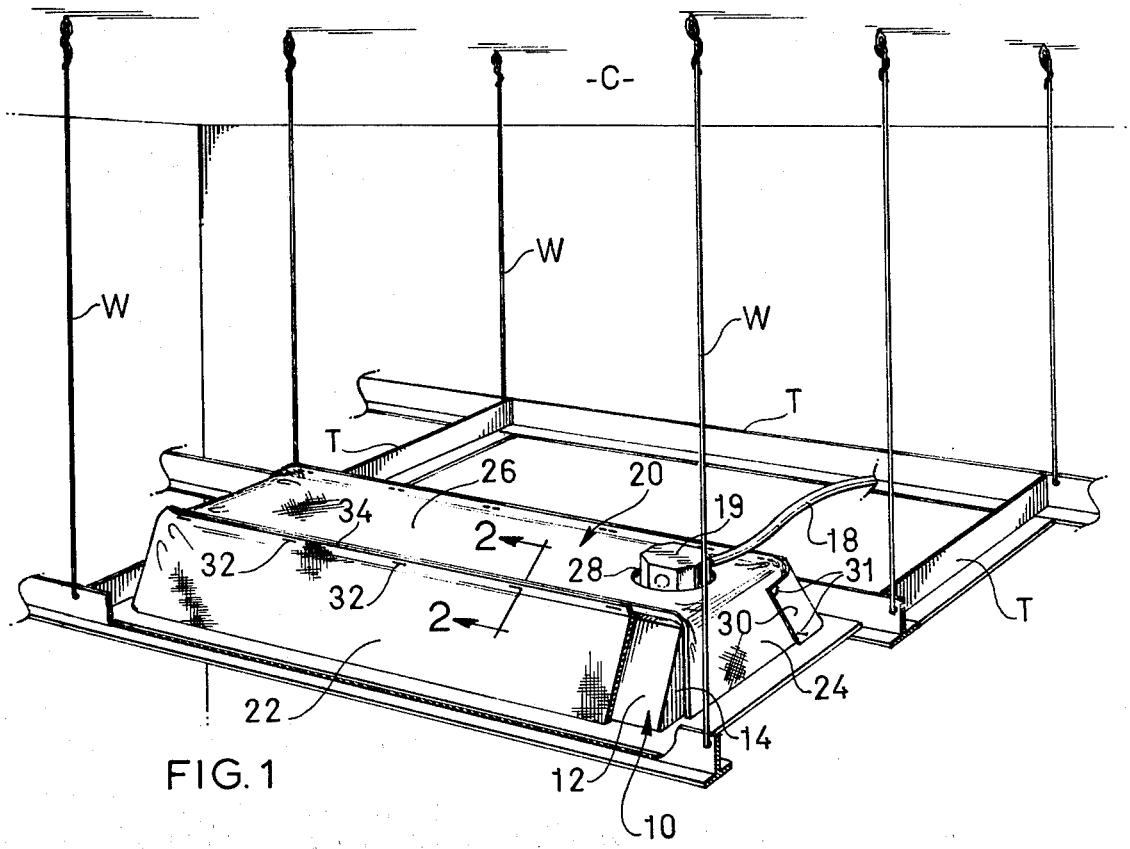
FIG. 1 is a fragmentary perspective view of a typical ceiling structure showing a ceiling lighting fixture in position therein and having disposed over that fixture one embodiment of a thermal shield or fire barrier in accordance with this invention.

Referring first to FIG. 1 of the accompanying drawings, it will be seen that there is shown therein a typical floor/ceiling or roof/ceiling assembly of a building structure and which comprises a concrete slab C which provides the roof of the building or the floor for the next storey of the building. Beneath the concrete slab C, there is suspended by wires W a plurality of interconnected struts or tees T in a known manner.

FIG. 1 also shows a ceiling lighting fixture indicated generally at 10 and which comprises a typical fluorescent lighting troffer having an elongated rectangular box-like shape with sloping side walls 12, end walls 14 and a top wall 16. Electrical power is supplied to the lighting fixture 10 by a cable or wire 18 terminating in a junction box 19.

In accordance with this invention, the lighting fixture 10 is provided with a thermal shield generally indicated at 20 and which has a rectangular inverted trough-like configuration and is dimensioned so that it fits loosely over the lighting fixture 10 in closely overlying relation thereto.

The particular thermal shield 20 shown in FIG. 1 comprises two opposed side walls 22 and a top wall 26 which is integrally formed with end walls 24. The two side walls 22 slope inwardly toward each other from the bottom to the top of the shield 20 and the two end walls 24 are also slightly angled relative to the vertical so as to correspond generally to the shape of the troffer.

In the top wall 26, there is provided an opening 28 for the junction box 19 and for access of the wire 18.

In accordance with one embodiment of this invention, the thermal shield 20 is of a multi-part construction and is formed of a flexible thermal barrier material which is essentially non-flammable within the temperature range for which the ceiling will be rated.

Figure 2:
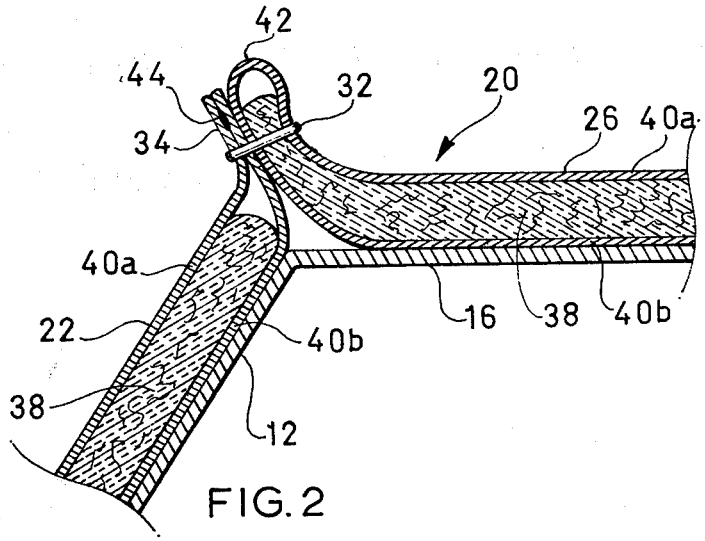
FIG. 2 is a fragmentary section along the line 2—2 of FIG. 1.

In order to permit the side walls 22 to be joined to the end walls 24, overlap portions 30 are provided at both ends of each of those side walls. Such overlap portions 30 may then be secured to the end walls 24, for example, by staples 31 applied at the site. The top wall 26 and the side walls 22 may similarly be secured together by staples 32 to provide a seam 34 as is best shown in FIG. 2.

The top wall 26 may have a one-piece construction as described or may be formed of several strips of thermal barrier material which are secured together for a wider fixture. In addition, the end walls 24 of the thermal shield 20 can be separate sheets of thermal barrier material which are secured, for example, by stapling to both the top wall 26 and the side walls 22.

Once fabricated, the thermal shield 20 is to all intents and purposes a permanent installation. If the lighting fixture 10 requires servicing, the shield can, however, readily be lifted up, removed or even partly dismantled by removal of the staples, and then replaced without destroying its effectiveness in the case of fire.

Figure 3:
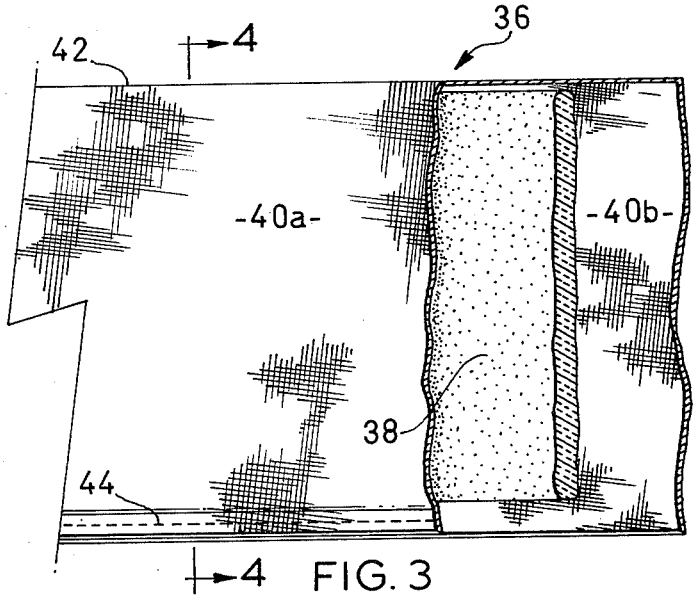
FIG. 3 is a fragmentary plan view of one form of thermal barrier material in accordance with this invention.
Figure 4:
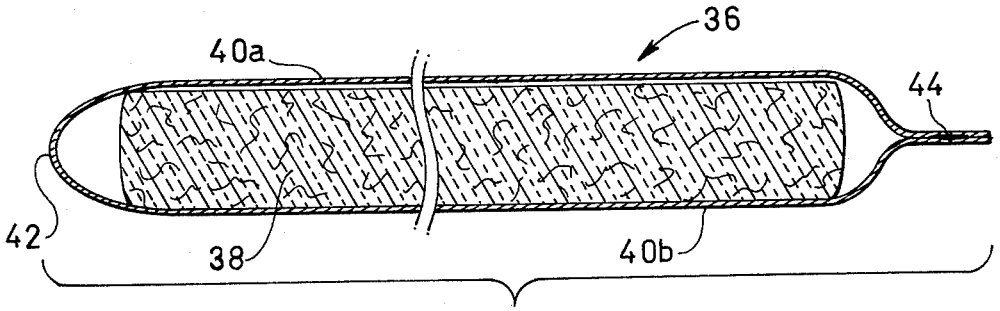
FIG. 4 is a transverse section through the material shown in FIG. 3 when taken as indicated by the arrows 4—4 of that figure.

Referring now to FIGS. 3 and 4, the thermal barrier material 36 in accordance with this invention is shown as comprising an unbonded multi-layer sandwich consisting of a median insulation layer or pad 38 of a known fibrous ceramic felt-like batting. Such material has a high degree of thermal insulation and is non-flammable. The ceramic fibres are simply formed into a loose non-woven felt or pad, and enclose a multiplicity of finely divided air spaces or cells.

In order to render the fragile or frangible material 38 sufficiently durable and, at the same time provide an additional degree of thermal insulation as well as some further flame protection, an outer sleeve comprising flexible and structurally durable sleeve walls or panels **40*a* and 40*b*** is provided. Such sleeve panels are usefully of woven glass fibre cloth which is usefully impregnated with aluminum powder in a thermoplastic base. Typically, the thermoplastic base will be a polyvinyl type thermoplastic.

In the particular barrier material 36 shown in FIGS. 3 and 4, the sleeve panels **40*a* and 40*b* are formed of a single piece of material which is folded along a fold line 42 to provide one side edge of the sheet. The panels 40*a* and 40*b* are joined, for example, by a pressure seam 44 along their opposite edges thereby to provide a continuous flattened loose sleeve encasing the frangible felt-like material 38. It is to be noted that the panels 40*a* and 40*b* are not bonded to the median layer 38 and, in fact, when the thermal barrier sheet material 36 is cut into lengths, the median layer 38 can slide to and fro between the panels 40*a* and 40*b***. This factor both enhances the entrapment of air, and reduces heat conduction through the material. It also has the unexpected advantage that the material will drape or hang in a loose, more flexible manner. This enables it to conform more closely to the contours of the various different shapes of fixtures, a consideration which is especially useful for a thermal barrier.

The thermal barrier material 36 is preferably provided in continuous rolls, for example, of fifty feet or more in length so that it may be readily shipped and handled at building sites. It can easily be cut with a knife or scissors, it is sufficiently flexible for it to be readily draped over fixtures of a variety of shapes, and it can be stapled with conventional industrial stapling machines.

Under test, the thermal barrier material 36 was found to be capable of withstanding the continuous application of a flame having a temperature of 2000° F. for a period of four hours. During such test, the temperature on the reverse side of the material did not exceed 350° F. When the flame was removed, the material was virtually undamaged.

The woven glass fibre sleeve structurally encases the frangible felt-like batting 38 and protects it from becoming pulled or shaken apart with the possible release of fibres into the building atmosphere. At the same time, the aluminum powder impregnated into the cloth reflects a large amount of heat and protects the cloth from heat and flame damage as well as improving its structural durability. By loosely wrapping the felt-like batting 38 in the sleeve, without any attempt to bond the batting to the sleeve, air is entrapped and this still further reduces heat transfer through the material.

When fabricated into thermal shields, such as the shield 20 already described, the thermal barrier material 36 provides a high degree of thermal protection when positioned over a ceiling fixture such as the lighting fixture 10.

Figure 5:
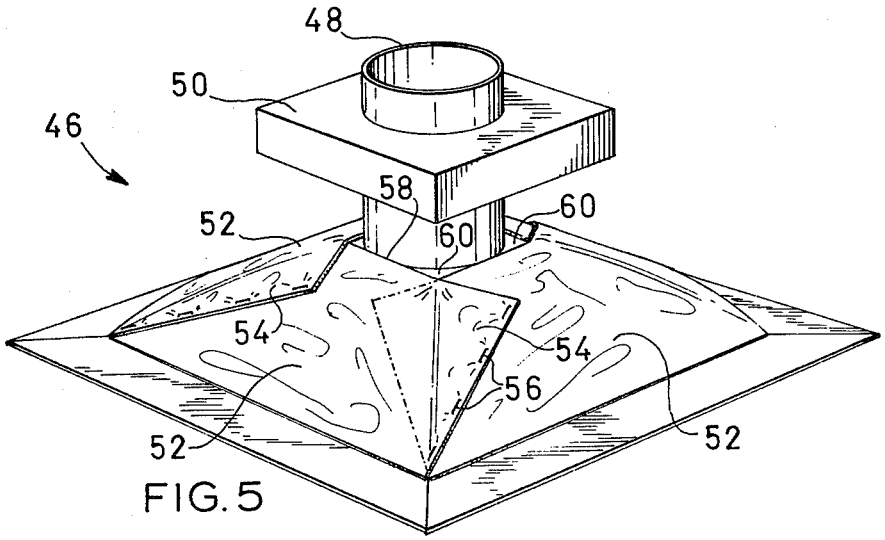
FIG. 5 is a perspective view of a ceiling air diffuser fitted with a thermal shield or fire barrier in accordance with the teaching of this invention.

The invention is, of course, equally applicable to the protection of other forms of ceiling fixtures such as, for example, an air-handling fixture such as the air diffuser 46 shown in FIG. 5.

The diffuser 46 shown in FIG. 5 is generally square at ceiling level but is designed to be connected to a round air duct 48. Consequently, such a diffuser is referred to as a square-to-round diffuser. The invention is, of course, equally applicable to the protection of diffusers of different configuration, for example, round-to-round diffusers which have a circular configuration at ceiling level and which are usually used in plastered ceilings.

The diffuser 46 is connected to the duct 48 through a housing 50 within which there is provided an automatic damper or curtain (not shown) for automatically closing off the duct 48 in the event of fire. Such fire dampers are well known in the art and, therefore, require no detailed description herein. They generally incorporate spring means which are actuated in response to heat so as to close off the duct. They may also incorporate fire-proof thermal insulation around the actual damper.

As shown in FIG. 5, thermal protection for the diffuser 46 itself is formed from the thermal barrier material 36 shown in FIGS. 3 and 4.

In this case, four panels or sheets 52 of such material are positioned on the four upper surfaces of the diffuser 46. Overlapped portions 54 are provided and such sheets are simply joined together, for example, by staples 56 passing through such overlapped portions 54 to leave a square opening defined by top edges 58.

It will be observed that relatively small and generally triangular corner portions 60 of the upper surfaces of the diffuser 46 remain exposed due to the fact that the opening defined by the top edges 58 is square while the duct connector is round. Such relatively small triangular portions 60, which are thus exposed, are, however, nevertheless protected by means of the damper 50 thereabove which will effectively block upward heat transmission from such small areas.

While the invention has hereinbefore been specifically described with reference to the particular embodiments thereof as shown in the accompanying drawings, it will be understood that numerous variations in and modifications of the described structures are possible within the scope of the invention. For example, the invention is not limited to the use of staples for fastening the pieces of the thermal barrier material together. Furthermore, it is equally within the scope of this invention to provide a thermal shield for a ceiling fixture from a single piece of the thermal barrier material 36 by securing such a piece of material into the required configuration. Additionally, a thermal shield in accordance with this invention can be fabricated from a thermal barrier material different from that specifically illustrated in FIGS. 3 and 4 of the accompanying drawings.

The foregoing is a description of preferred embodiments of the invention which is given here by way of example only. The invention is not to be taken as limited to any of the specific features as described, but comprehends all such variations thereof as come within the scope of the appended claims.

What is claimed is:

1. A thermal barrier material for the on-side fabrication of a thermal shield in a ceiling structure over a fixture therein and which material is formed of a plurality of separate layers in surface to surface contact, the surface of each layer being unbonded to the surface of the next adjacent layer, and comprising an intermediate layer formed of a non-woven felt-woven flexible pad of non-flammable and frangible batting of fibrous ceramic material and two outer sleeve layers of panels of a flexible, structurally durable synthetic fibrous woven non-flammable material, to form a protective flexible sleeve around said batting and means fastening said sleeve layers together at spaced intervals, and securing said batting layer in surface to surface contact therebetween but said surfaces being unbonded to one another to provide a flexible material adapted to drape over a said fixture and conform thereto.

2. A thermal barrier material as claimed in claim 1 and in which said sleeve panels are formed of a woven glass fibre cloth.

3. A thermal barrier material as claims in claim 2 in which said sleeve panels are formed of a woven glass fibre cloth impregnated with aluminum powder in a thermoplastic base and in which said batting is a loose fibrous ceramic felt-like material enclosing a multiplicity of finely divided air cells.

4. A thermal shield for a fixture in a ceiling structure, and which comprises at least one unbonded multi-layer structure comprising a flexible pad of non-flammable and non-woven fibrous batting and two outer sleeve panels of a flexible, structurally durable synthetic fibrous woven non-flammable material, said sleeve panels being fastened together at intervals securing said batting layer in surface to surface contact therebetween but said surfaces being unbonded to one another to provide a flexible material adapted to drape over a said fixture and conform thereto, said shield having a three-dimensional configuration, and, holding means engaging a plurality of layers of such structure and retaining same in said three-dimensional configuration.

5. A thermal shield as claimed in claim 4, in which said sleeve panels are formed of a woven glass fibre cloth impregnated with aluminum powder in a thermoplastic base and in which said batting is a loose fibrous ceramic felt-like material enclosing a multiplicity of finely divided air cells.

6. A thermal shield as claimed in claim 5 and in which said flexible pad is movably disposed in said sleeve panels, between the fastening locations thereof.

7. A thermal shield as claimed in claim 6 and which comprises at least two said multi-layer structures and a plurality of holding means whereby such multi-layer structures are secured together to provide such a three-dimensional configuration.

8. A ceiling structure including a three-dimensional fixture, and a thermal shield in closely overlying relation thereto, which shield comprises at least one multy-layer barrier material comprising a flexible pad of non-flammable non-woven fibrous batting and two outer sleeve panels of a flexible, structurally durable synthetic fibrous woven non-flammable material, said sleeve panels being fastened together at spaced intervals securing said batting in surface to surface contact therebetween but said surfaces being unbonded to one another to provide a flexible material adapted to drape over a said fixture and conform thereto, and said thermal shield having a three-dimensional configuration corresponding generally to the configuration of said fixture.

9. A ceiling structure as claimed in claim 8 and in which said shield comprises at least two said multi-layer structures and a plurality of holding means securing same together so as to provide a shield having a said three-dimensional configuration corresponding to the configuration of said fixture.

10. A ceiling structure as claimed in claim 9 in which said three-dimensional fixture is an air diffuser.

* * * * *